US005497994A

United States Patent [19]

Hansen et al.

[11] Patent Number: 5,497,994

[45] Date of Patent: Mar. 12, 1996

[54] PINBALL MOVABLE DOORS

[75] Inventors: Bryan P. Hansen, DesPlaines; Rick Morgan, Arlington Heights, both of Ill.

[73] Assignee: CAPCOM Coin-Op, Inc., Arlington Heights, Ill.

[21] Appl. No.: 386,373

[22] Filed: Feb. 10, 1995

Related U.S. Application Data

[63] Continuation-in-part of Ser. No. 255,480, Jun. 8, 1994, Pat. No. 5,417,427.

[51] Int. Cl.[6] ..... A63F 7/22

[52] U.S. Cl. ..... 273/121 A; 273/118 R; 273/118 A; 273/119 R; 273/119 A; 273/121 R

[58] Field of Search ..... 273/118, 119, 273/121, 127

[56] References Cited

U.S. PATENT DOCUMENTS

| | | | |
|---|---|---|---|
| 3,901,511 | 8/1975 | Garbark | 273/119 A |
| 5,181,722 | 1/1993 | Krutsch et al. | 273/118 A X |
| 5,330,182 | 7/1994 | Kaminkow | 273/118 R X |
| 5,417,422 | 5/1995 | Hansen | 273/118 A X |
| 5,417,423 | 5/1995 | Oursler et al. | 273/121 A X |

*Primary Examiner*—Raleigh W. Chiu
*Attorney, Agent, or Firm*—Robert E. Browne; Gary R. Jarosik

[57] ABSTRACT

A pinball game using a pinball adapted to be propelled along a playfield is provided. The pinball game includes a target mounted above the playfield and first and second movable objects mounted above the playfield which are movable between a closed position wherein the first and second movable objects are disposed substantially adjacent to each other and an open position wherein the first and second movable objects are disposed substantially apart from each other. A solenoid having a plunger movable between an extended position and a retracted position in response to contact of the target by the pinball. An arm rotatable about a pivot point having first and second ends displaced from the pivot point is linked to the plunger at a point spaced from the pivot point. A first link connects the first end of the arm to one of the movable objects and a second link connecting the second end of the arm to the other of the movable objects. Movement of the plunger between the extended and retracted positions causes the movable objects to move between the open and the closed positions.

8 Claims, 17 Drawing Sheets

PINBALL MOVABLE DOORS

RELATED APPLICATION

This application is a continuation-in-part of U.S. patent application Ser. No. 08/255,480, filed Jun. 8, 1994, now U.S. Pat. No. 5,417,422 entitled "Pinball Optical Illusion Techniques", which remains pending.

FIELD OF THE INVENTION

This invention relates to a pinball machine, and more particularly relates to such a machine in which the pinball is manipulated outside of the view of a pinball player behind a pair of closable doors.

DESCRIPTION OF THE PRIOR ART

Devices to move objects on the playfield of a pinball machine are known in the art. These devices typically consist of a motorized drive used to move an object laterally or a solenoid used to move a single object in the up/down direction. However, as far as the applicant is aware, there has not been utilized a single solenoid for use in moving a plurality of objects which objects are further movable in a plane substantially perpendicular to the plane in which the playfield resides.

It is, therefore, an object of the present invention to provide a mechanism for moving objects on the playfield of a pinball in which the moving mechanism is reduced in size to provide the advantage of saving playfield space.

SUMMARY OF TEE INVENTION

In accordance with this object, a device for moving a pair of movable objects in a pinball game is provided. The device includes a solenoid having a plunger movable between an extended position and a retracted position, an arm rotatable about a pivot point having first and second ends displaced from the pivot point where the arm is linked to the plunger at a point spaced from the pivot point, a first link which connects the first end of the arm to one of the movable objects, and a second link which connects the second end of the arm to the other of the movable objects. Movement of the plunger between the extended and the retracted positions causes rotation of the arm which in turn provides simultaneous movement of both of the movable objects.

BRIEF DESCRIPTION OF TEE DRAWINGS

These and other objects, advantages and features of the invention will appear for purposes of illustration, but not of limitation, in connection with FIGS. 1–15 wherein like numbers refer to like parts throughout and in which.

DETAILED DESCRIPTION OF THE PREFERRED EMBODIMENT

Figure 1:
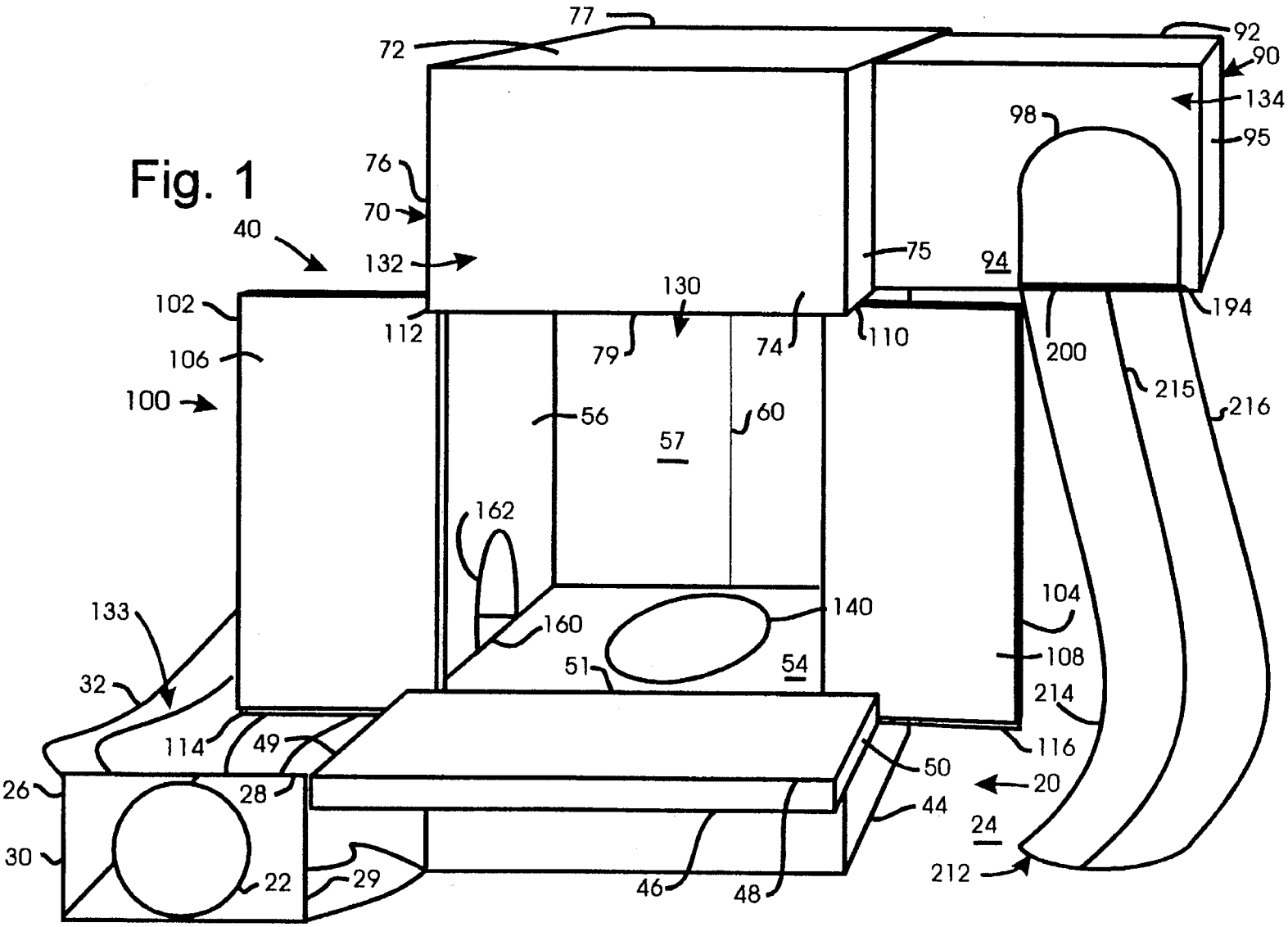
FIG. 1 is a perspective view of a preferred form of apparatus made in accordance with the present invention in the form of a stage for displaying a pinball.

Referring to FIG. 1, the preferred embodiment preferably is used in connection with a pinball game 20 employing a pinball 22 rolling on a pinball playfield 24. The player attempts to propel pinball 22 into a target 26 comprising guide walls 28–30 arranged as shown (FIG. 1). Interior portions of target 26 may be concealed from the player's view by any convenient means, such as a fabric cover 32.

Figure 2:
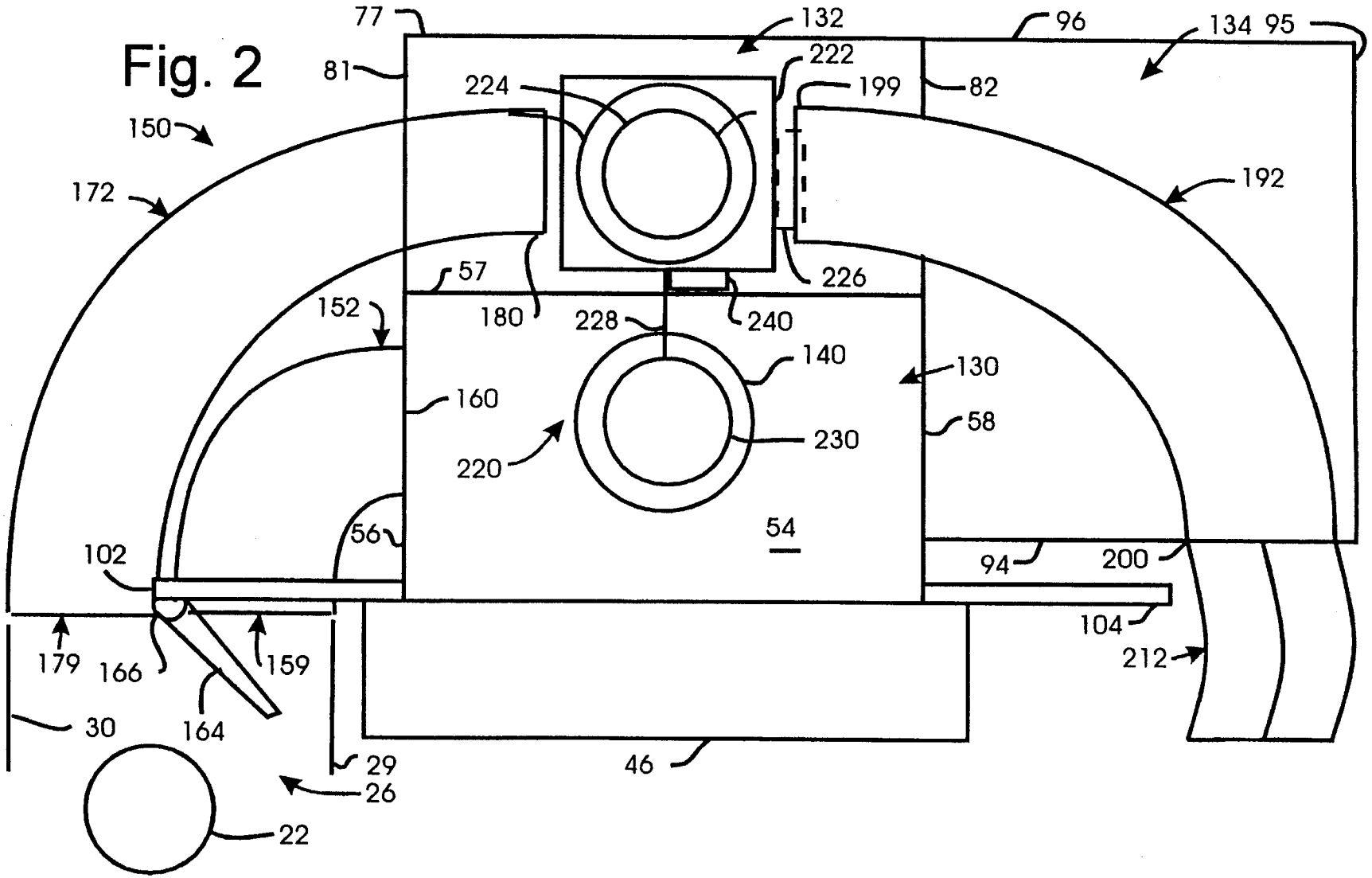
FIG. 2 is a top plan view of the apparatus shown in FIG. 1 with the covers removed.
Figure 3:
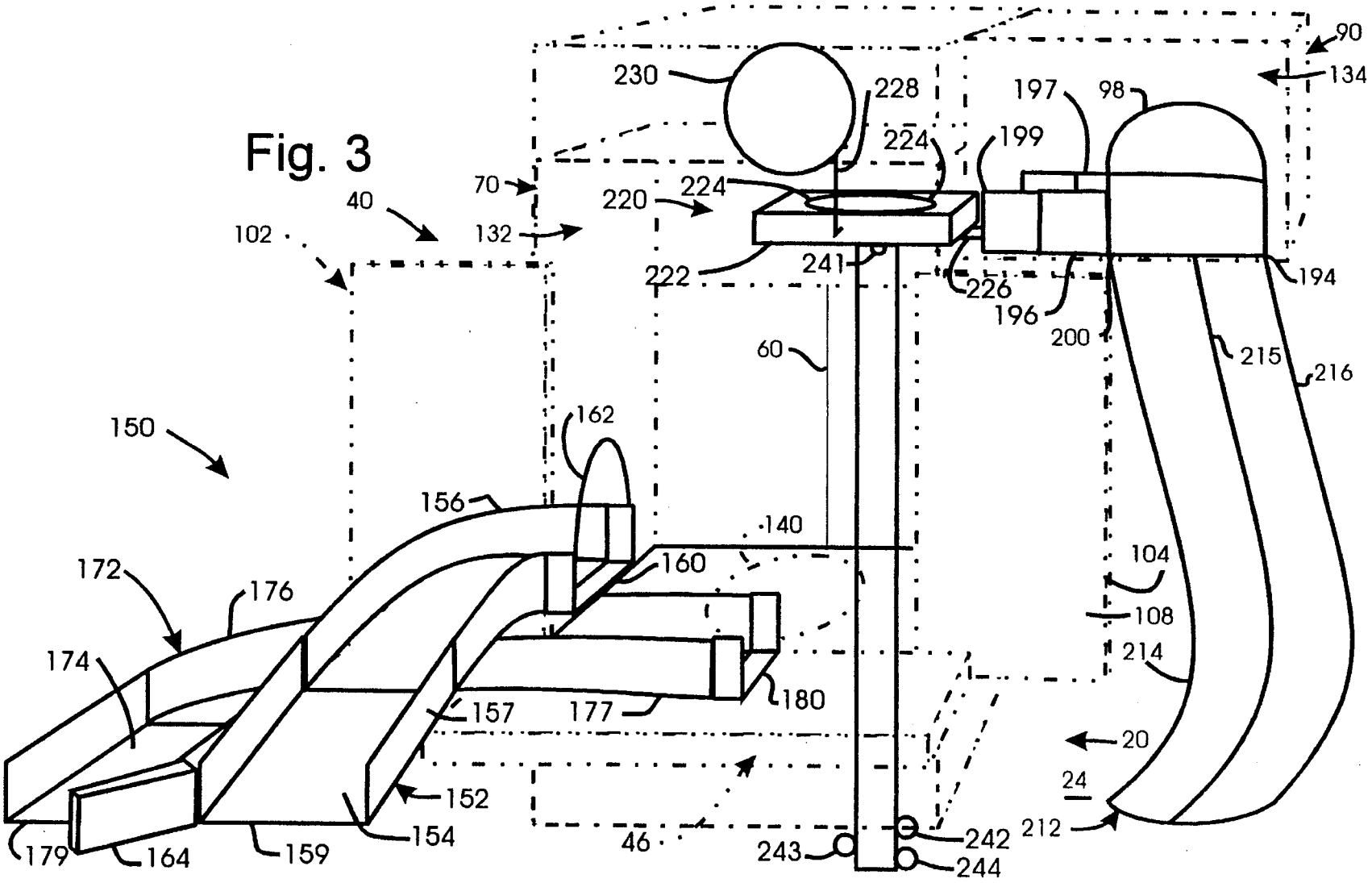
FIG. 3 is a perspective view of the apparatus shown in FIG. 1 with outer structural features shown in phantom to reveal interior features.

Referring to FIGS. 1–3, the preferred embodiment basically comprises a stage assembly 40, a guide assembly 150 and a lift assembly 220. Stage assembly 40 comprises a base 44 which is supported by playfield 24. The base carries a proscenium 46 having an upper surface 48, a left edge 49, a right edge 50 and a rear edge 51. Behind the proscenium on the same level as upper surface 48 is a rear stage floor 54. The stage floor is partially enclosed by vertical stage walls 56–58. A slot 60 bisects rear wall 57.

Stage assembly 40 also includes a loft enclosure 70 having an upper surface 72 and vertical walls 74–77. Back wall 77, as well as rear portions 81 and 82 of side walls 75 and 76, may extend downward to playfield 24 in order to conceal apparatus behind the stage area. Vertical front wall 74 has a lower edge 79.

Stage 40 also includes a loft extension assembly 90 having an upper surface 92 and vertical walls 94–96 arranged as shown. Wall 94 defines a pinball opening 98 from which a pinball may exit and descend to playfield 24.

Figure 1A:
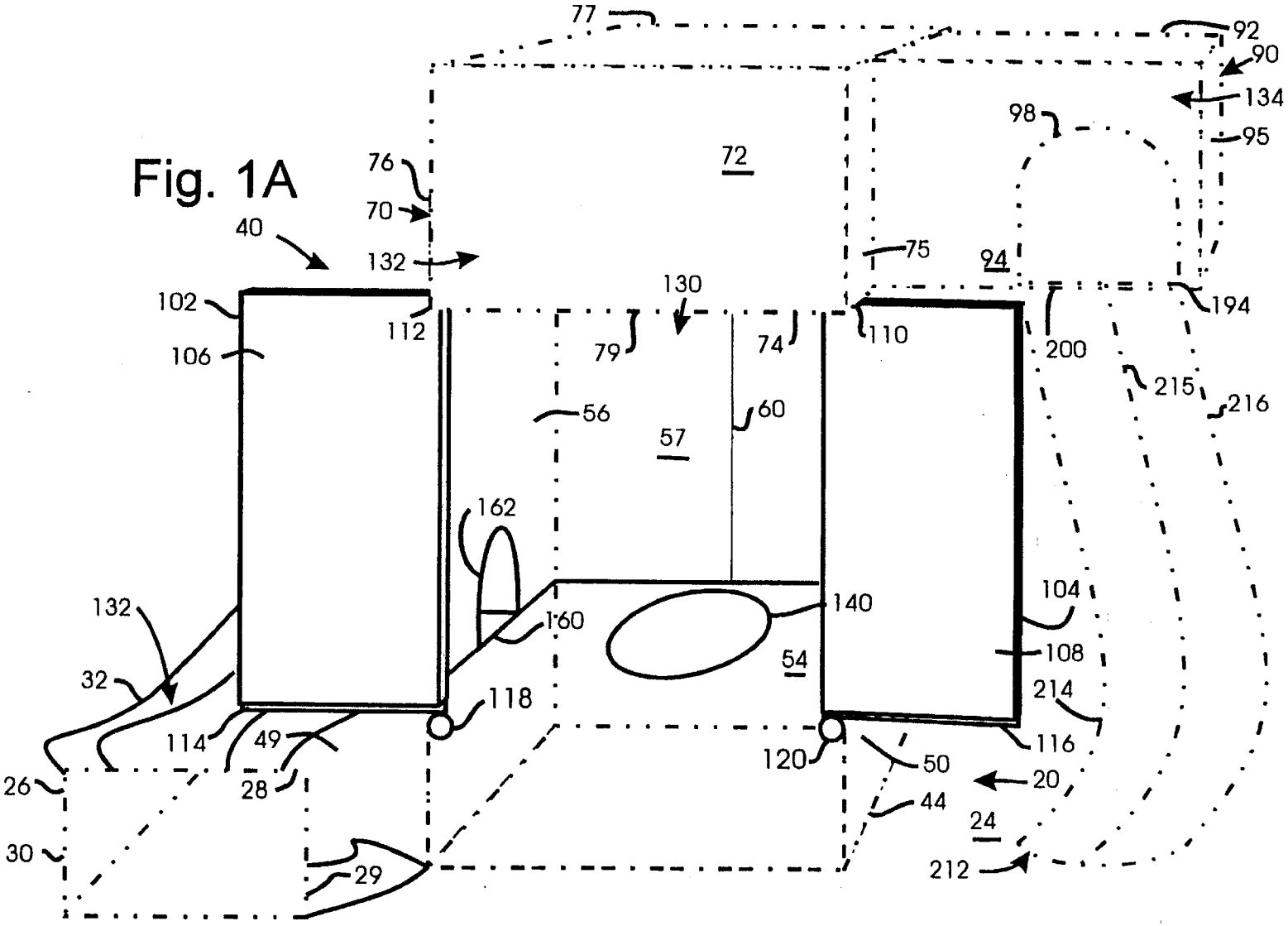
FIG. 1A illustrates the apparatus shown in FIG. 1 with the proscenium removed to reveal interior parts.

Stage assembly 40 also includes a stage screen assembly 100 having stage screens 102 and 104 that are fitted with forward surfaces 106 and 108 that may be decorated in any convenient manner. Screens 102 and 104 comprise a movable closure medium. The screens ride on rack gears 114 and 116 which are engaged by pinion gears 118 and 120 (FIG. 1A) in order to open and close the screens.

The stage assembly defines a display area 130 which extends from stage floor 54 to the lower edge 79 of loft enclosure 70 and which lies within walls 56–58 and within the vertical projection of edge 51 of proscenium 46. The state assembly also defines hidden areas 132–134 as shown in FIGS. 1 and 2.

Stage floor 54 is fitted with a conventional saucer cup 140. As known to those skilled in the art, the saucer cup has an internal mechanism extending below floor 54 that enables pinball 22 to be ejected toward the front of the stage so that it rolls over proscenium 46 and onto a playfield 24 when activated.

Referring to FIGS. 2 and 3, guide assembly 150 includes guides 152, 172, 192 and 212. Pinball guide 152 has a flat bottom 154 and vertical side rails 156 and 157. Guide 152 includes an entrance end 159 and an exit end 160. Pinball 22 exits through arch 162 that is cut into sidewall 56. Guide 152 enables pinball 22 to travel from playfield 24 onto stage floor 54 and into saucer cup 140.

A diverter gate 164, that is pivoted around a vertical axis by means of a conventional pivot 166, can divert pinball 22 into guide 152 or guide 172.

Guide 172 includes a flat bottom 174 and vertical side rails 176 and 177. Guide 172 has an entrance end 179 and an exit end 180. Bottom 174 lies on playfield 24 and extends behind and below stage floor 54.

Guide 192 includes a flat bottom 194 and vertical side rails 196 and 198. Guide 192 has an entrance end 199 and an exit end 200.

After pinball 22 exits opening 98, it is carried back to playfield 24 by means of guide 212 comprising three wires 214–216 arranged as shown (FIG. 1–3).

Referring to FIGS. 2 and 3, lift assembly 220 comprises a carriage 222 having a central cup 224 suitable for receiving and carrying pinball 22. A lip 226 is attached to the lower edge of carriage 222 as shown and is made to comate with end 199 of guide 192. A support wire 228 supports a second pinball 230. Carriage 222 is supported through a pivot 241 by a rack gear 240 that is driven in a vertical direction by conventional pinion gears 242–244 (FIG. 3). Lift assembly 220 is concealed in hidden area 132, except for ball 230 which extends into display area 130. Support wire 228 extends through slot 60 in order to support pinball 230.

Figure 4:
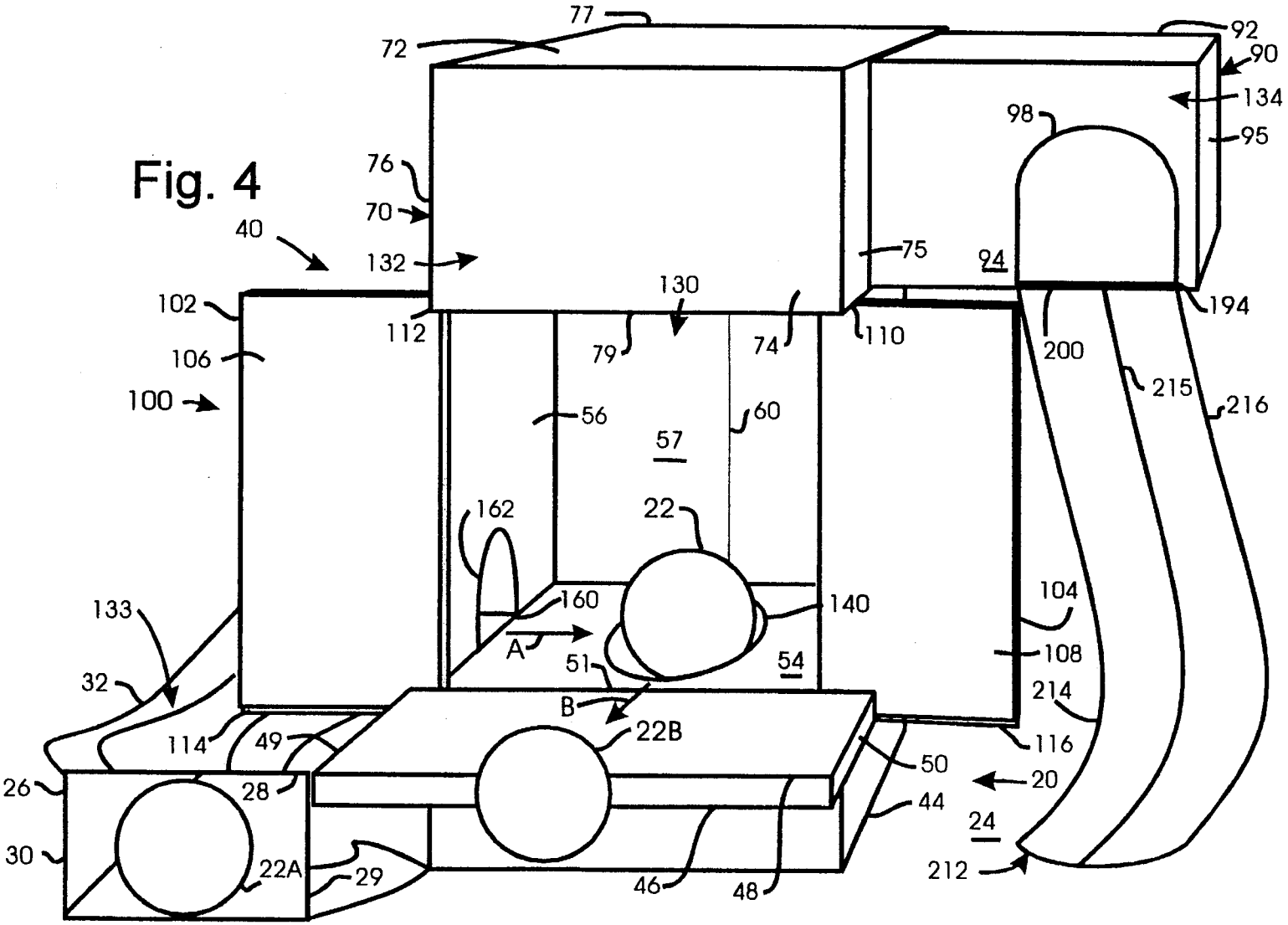
FIG. 4 illustrates the apparatus shown in FIG. 1 with a pinball displayed on the stage during a first operating state.
Figure 5:
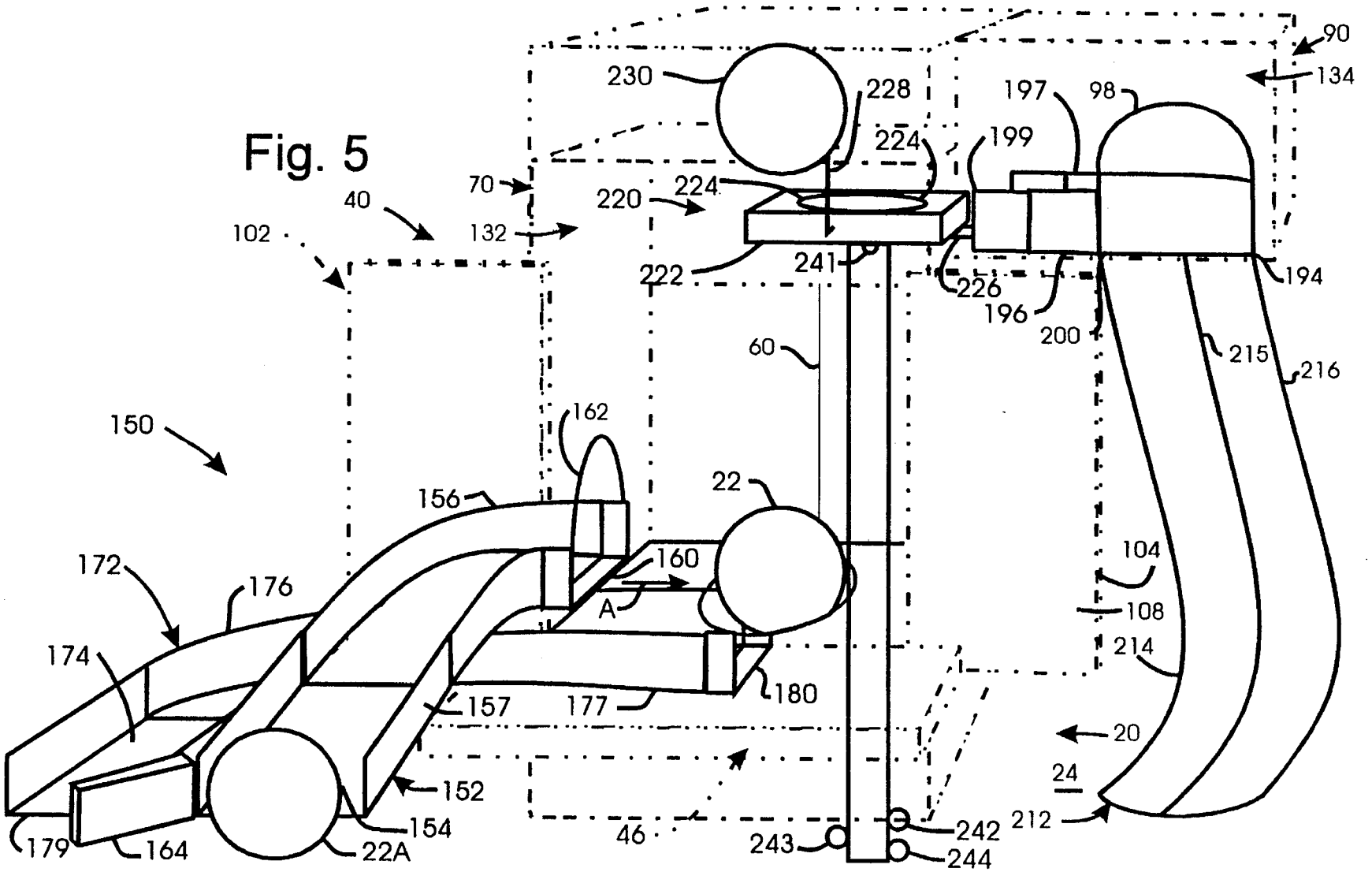
FIG. 5 illustrates the apparatus shown in FIG. 3 illustrating movement of pinballs during the first operating state.

The preferred embodiment includes a first operating state in which the player is encouraged to propel pinball 22 into target 26 (FIG. 1). As shown in FIGS. 4 and 5, during the first operating state, pinball 22 is diverted by diverter 164 into guide 152 and through arch 162 into saucer cup 140. After a predetermined time period of display in cup 140, the pinball is ejected and rolls over surface 48 of proscenium 46 back onto playfield 24. Pinball 22A and arrow A illustrate the progress of pinball 22 as it travels through guide 152 to saucer cup 140 during the first operating state. Pinball 22B and arrow B (FIG. 4) illustrate a typical path of pinball 22 after it is ejected from saucer cup 140.

Figure 6:
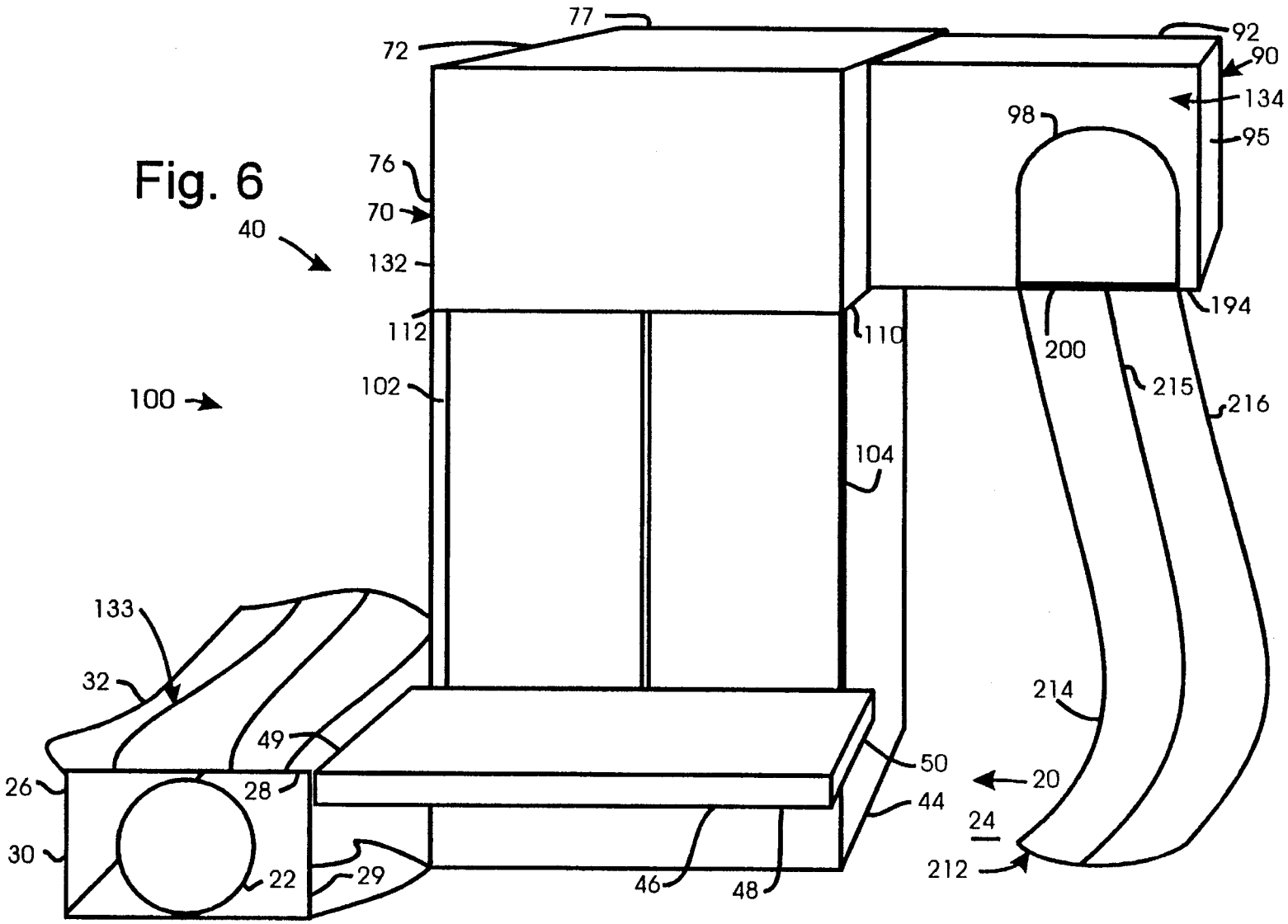
FIG. 6 illustrates the apparatus shown in FIG. 1 with state screens closed.

After the player has successfully propelled pinball 22 into target 26 a few times during the first operating state, he is conditioned to seeing the pinball roll through arch 162 and into saucer cup 140 in display area 130. Thereafter, a microprocessor controlling operation of the game can illuminate a display panel urging the player the again propel pinball 22 into target 26 in order to obtain bonus points. At this point in time, the game enters a second operating state in which stage screens 102 and 104 are closed as shown in FIG. 6. During the closure of screens 102 and 104, diverter gate 164 is rotated to the position shown n FIG. 7 to divert pinball 22 into guide 172. Guide 172 extends along the surface of playfield 24 to a portion of hidden area 132 located behind wall 57.

Figure 7:
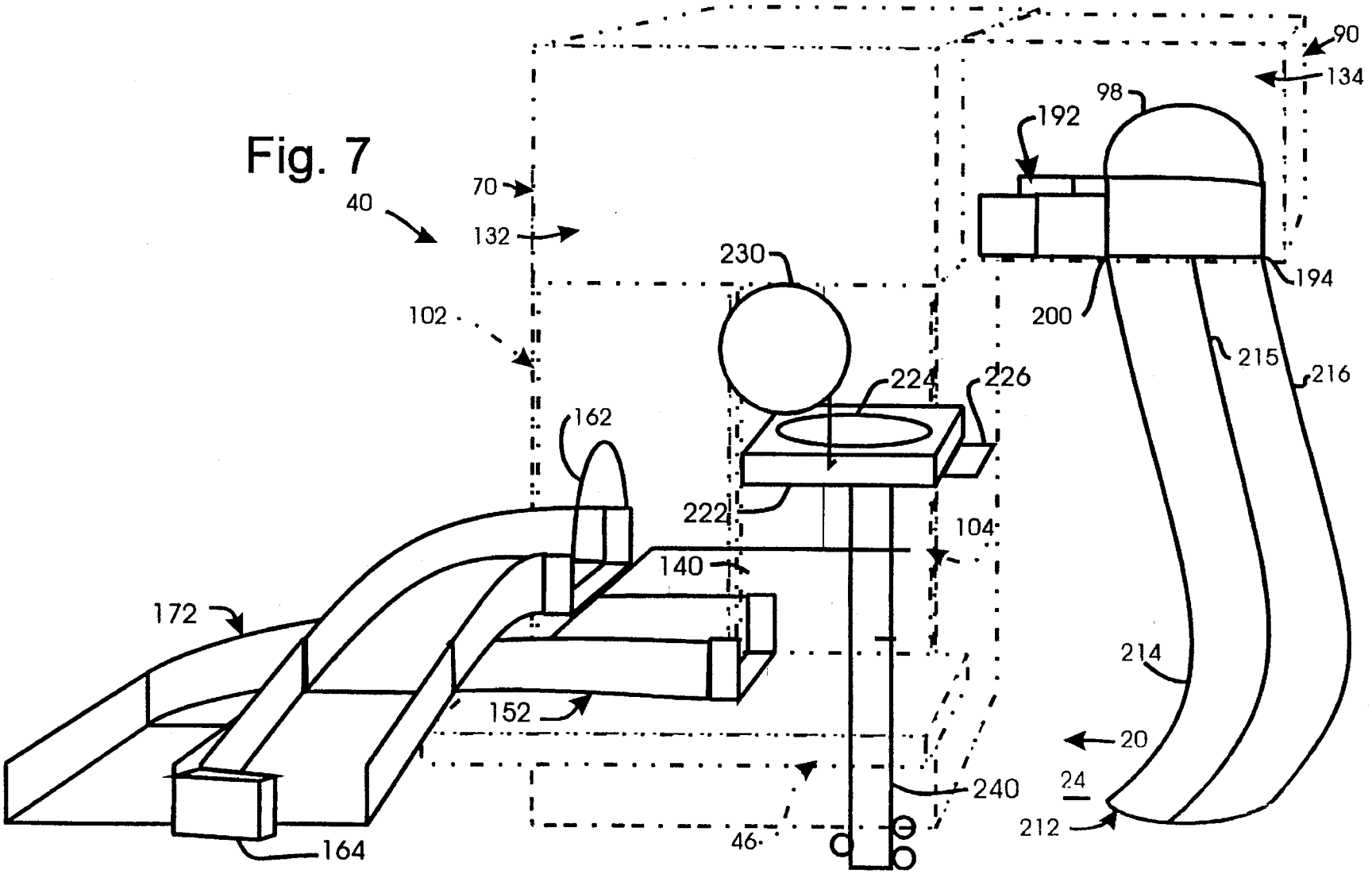
FIG. 7 illustrates the apparatus shown in FIG. 3 with the stage screens closed and a second pinball being moved into the stage area during a second operating state.
Figure 8:
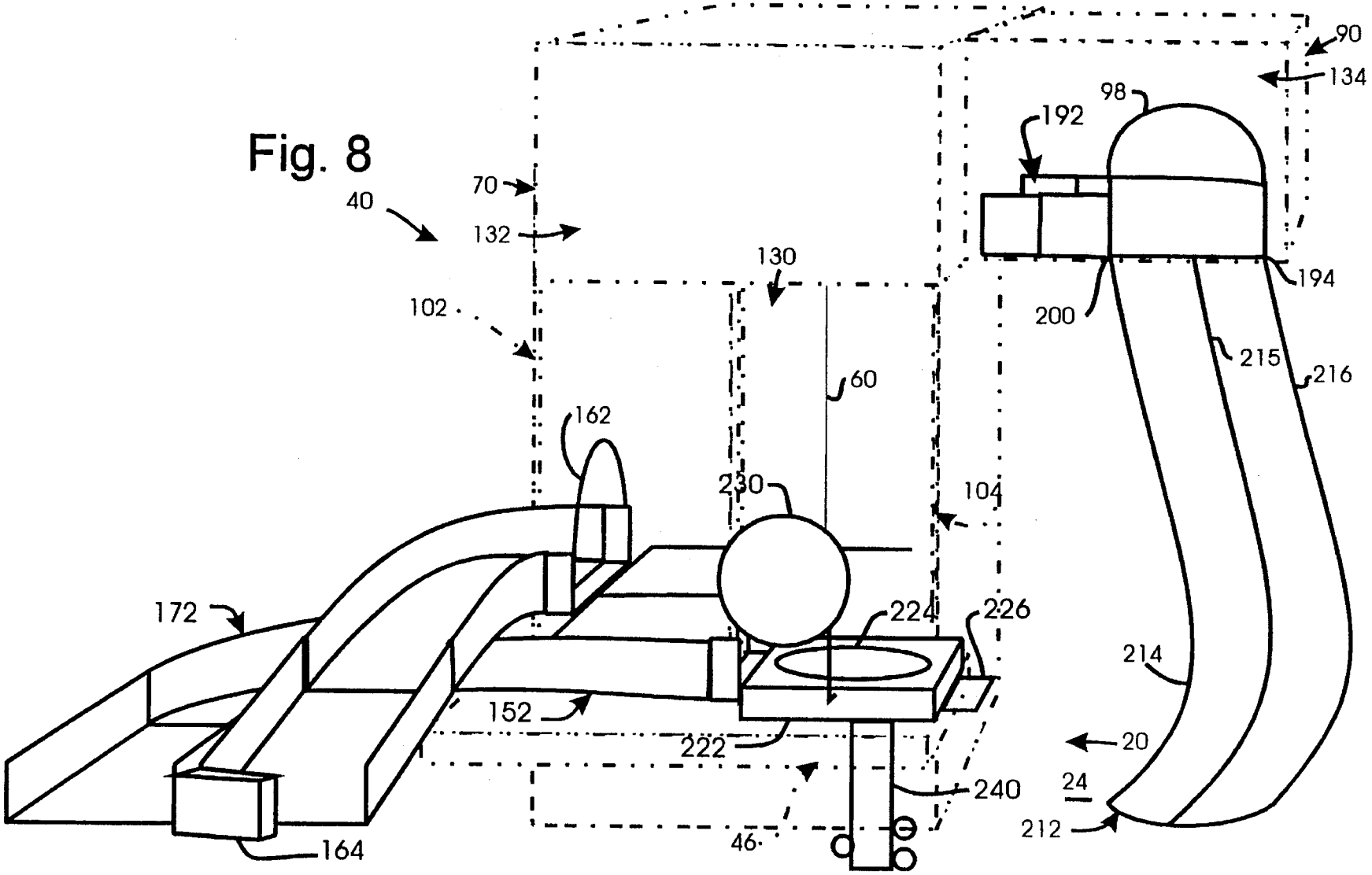
FIG. 8 illustrates the apparatus shown in FIG. 3 with a second pinball fully descended into the stage area during the second operating state.
Figure 9:
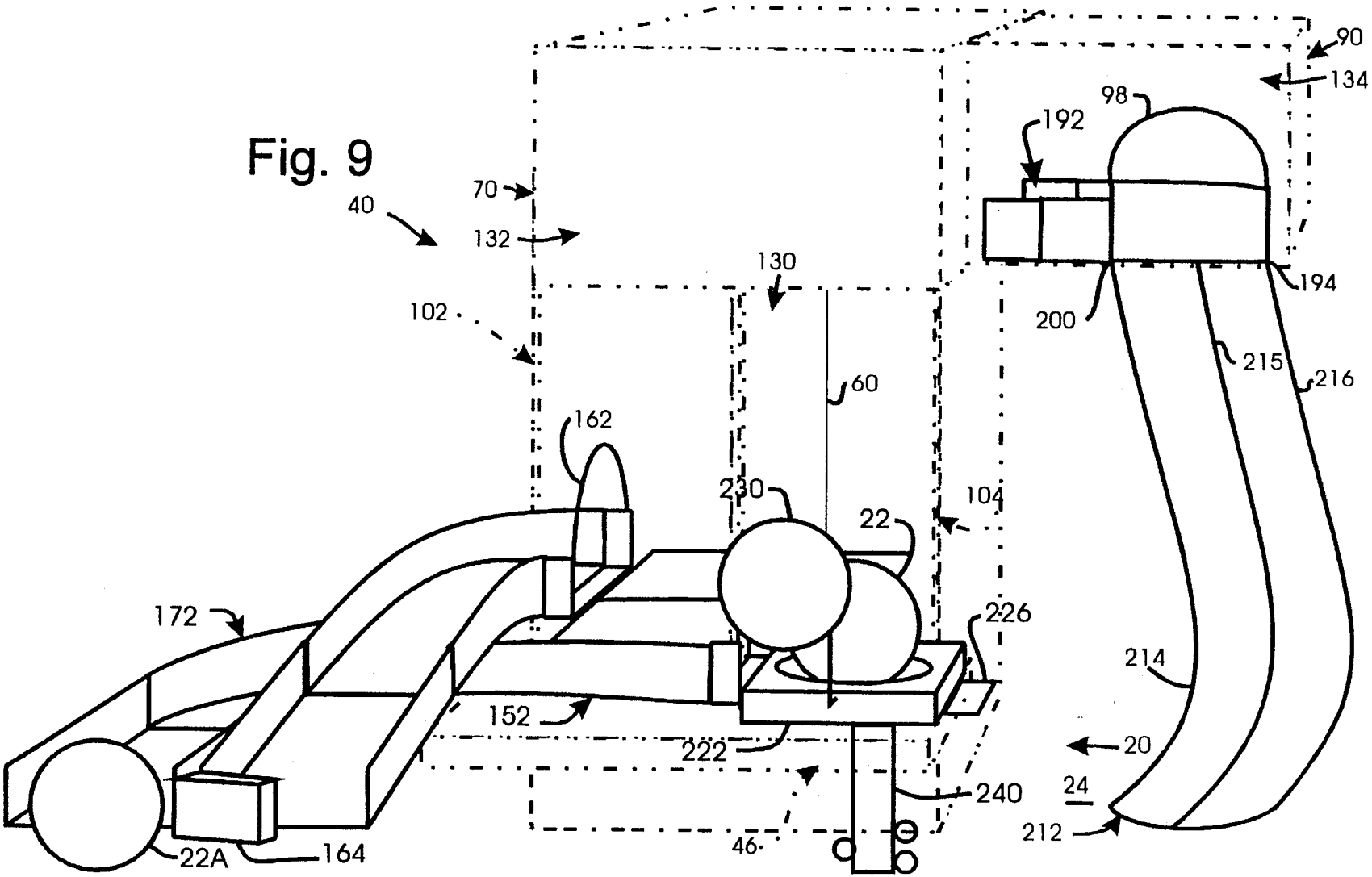
FIG. 9 illustrates the apparatus shown in FIG. 8 with the first pinball located in a hidden area behind the stage and the screens closed.

After screens 102 and 104 are closed, lift assembly 220 descends from loft area 70 as shown in FIG. 7. The lift is lowered due to the operation of pinion gears 242–244 which cause rack gear 240 to descend. (The lower end of gear 240 extends below the view of the drawing and is not shown). Lift assembly 220 quickly is lowered to the position shown in FIG. 8 in which carriage 222 is aligned with exit end 180 of guide 172 so that pinball 22 emerging from exit end 180 will be received by and held by central cup 224. After lift assembly 220 is fully descended, during the second operating state, if the player successfully propels pinball 22 into target 26, the pinball is guided into cup 224 as shown in FIG. 9. Pinball 22A illustrates the position of pinball 22 at the entrance to guide 172.

Figure 10:
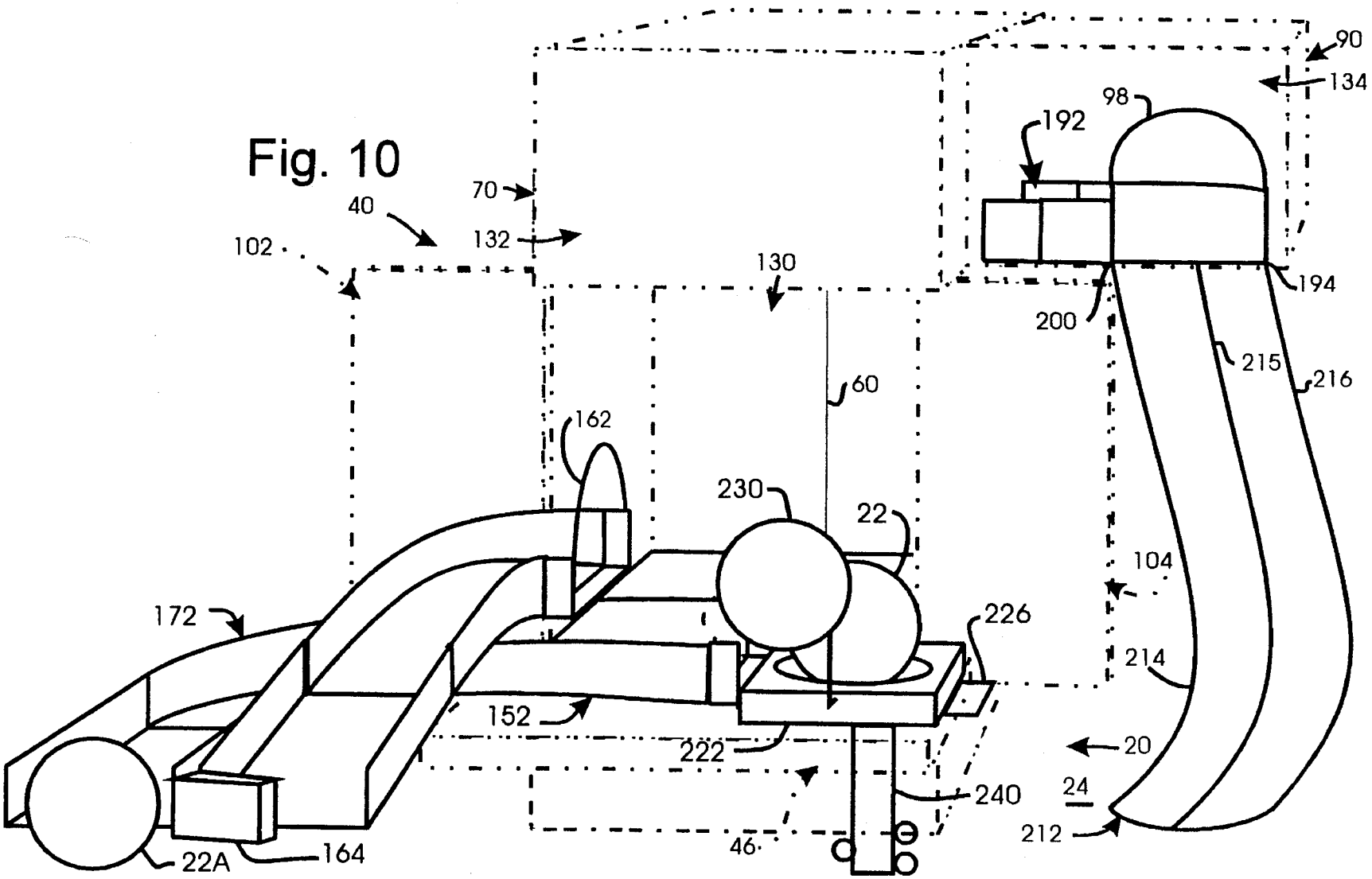
FIG. 10 illustrates the apparatus shown in FIG. 9 with the stage screens open.
Figure 11:
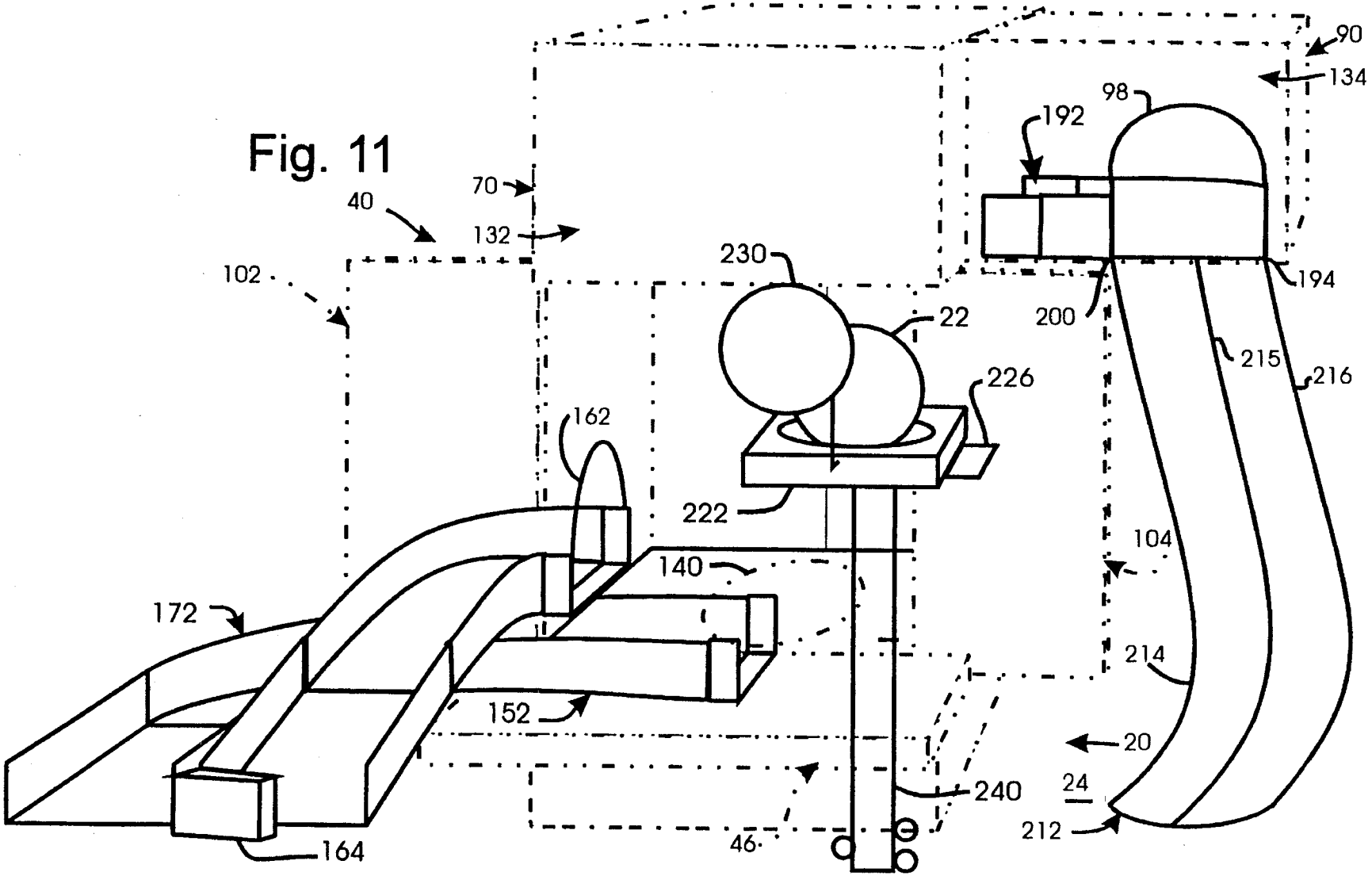
FIG. 11 illustrates the apparatus shown in FIG. 9 but with the screens opened and the second pinball ascending above the stage.

After pinball 22 is in cup 224, screens 102 and 104 are opened as shown in FIG. 10. The real pinball 22 is in cup 224 behind the stage and out of sight. However, the player sees pinball 230 in saucer cup 140 and assumes that it is the real pinball. Thereafter, lift assembly 220 is raised in order to crease the illusion that the real pinball is rising out of saucer cup 140 in defiance of the laws of gravity. FIG. 11 illustrates the lift assembly 220 being raised to create the illusion of a floating pinball.

Figure 12:
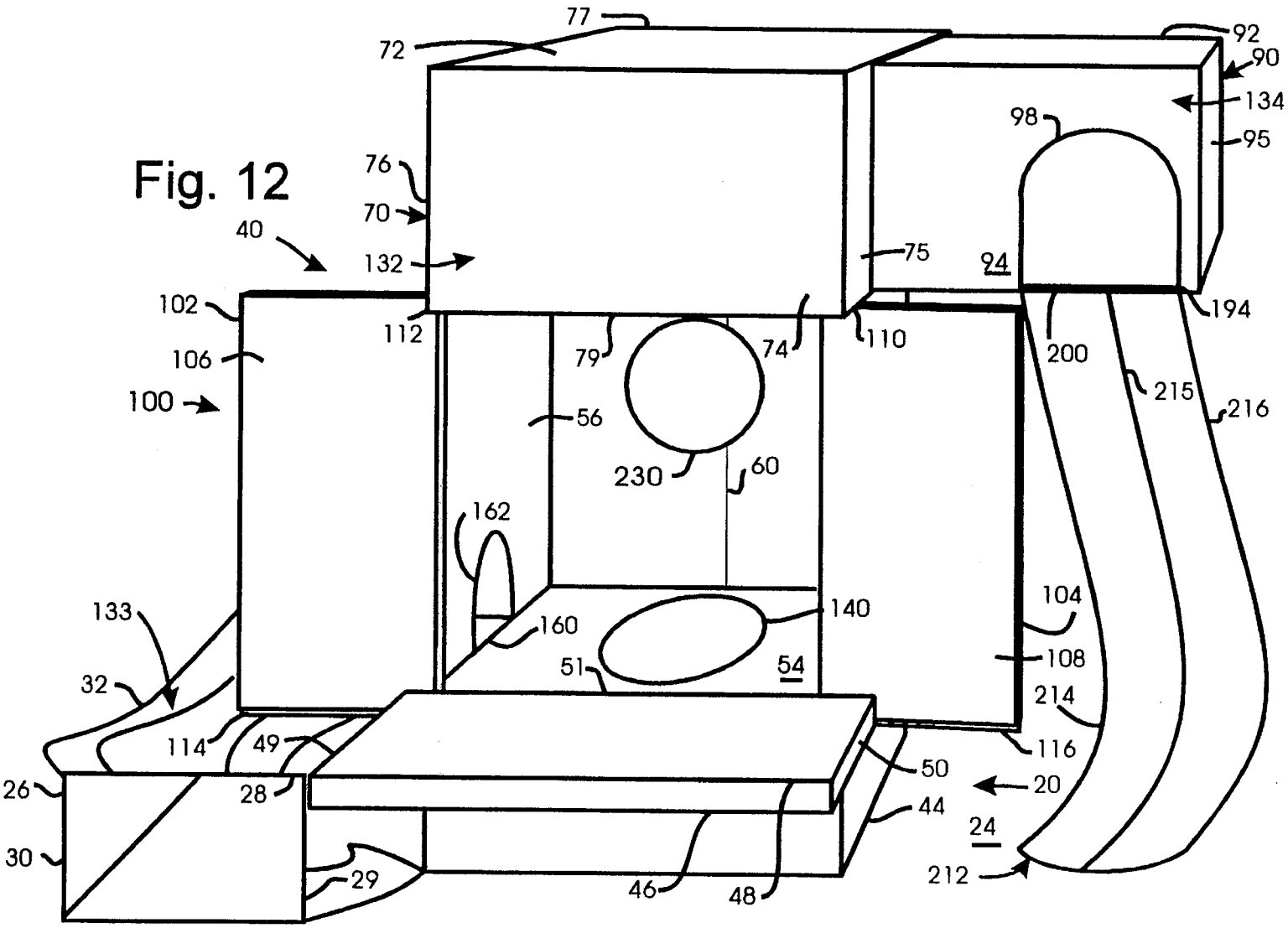
FIG. 12 illustrates the apparatus shown in FIG. 1 with the second pinball ascending above the stage area during the second mode of operation.

FIG. 12 illustrates the stage as seen by the player with pinball 230 ascending.

Figure 13:
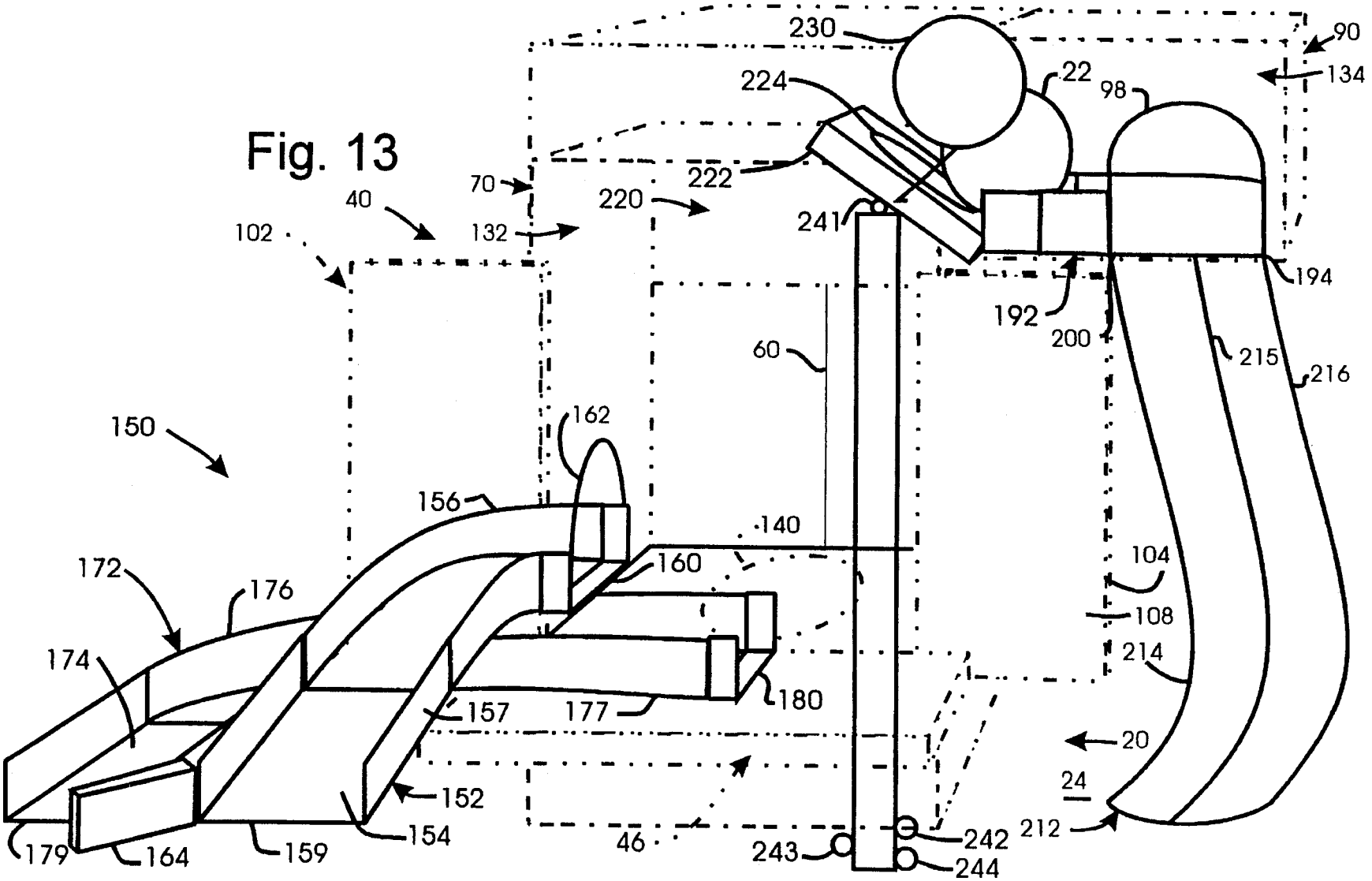
FIG. 13 illustrates the apparatus shown in FIG. 3 in which the second pinball is being guided into a ball guide for return to the playfield.
Figure 14:
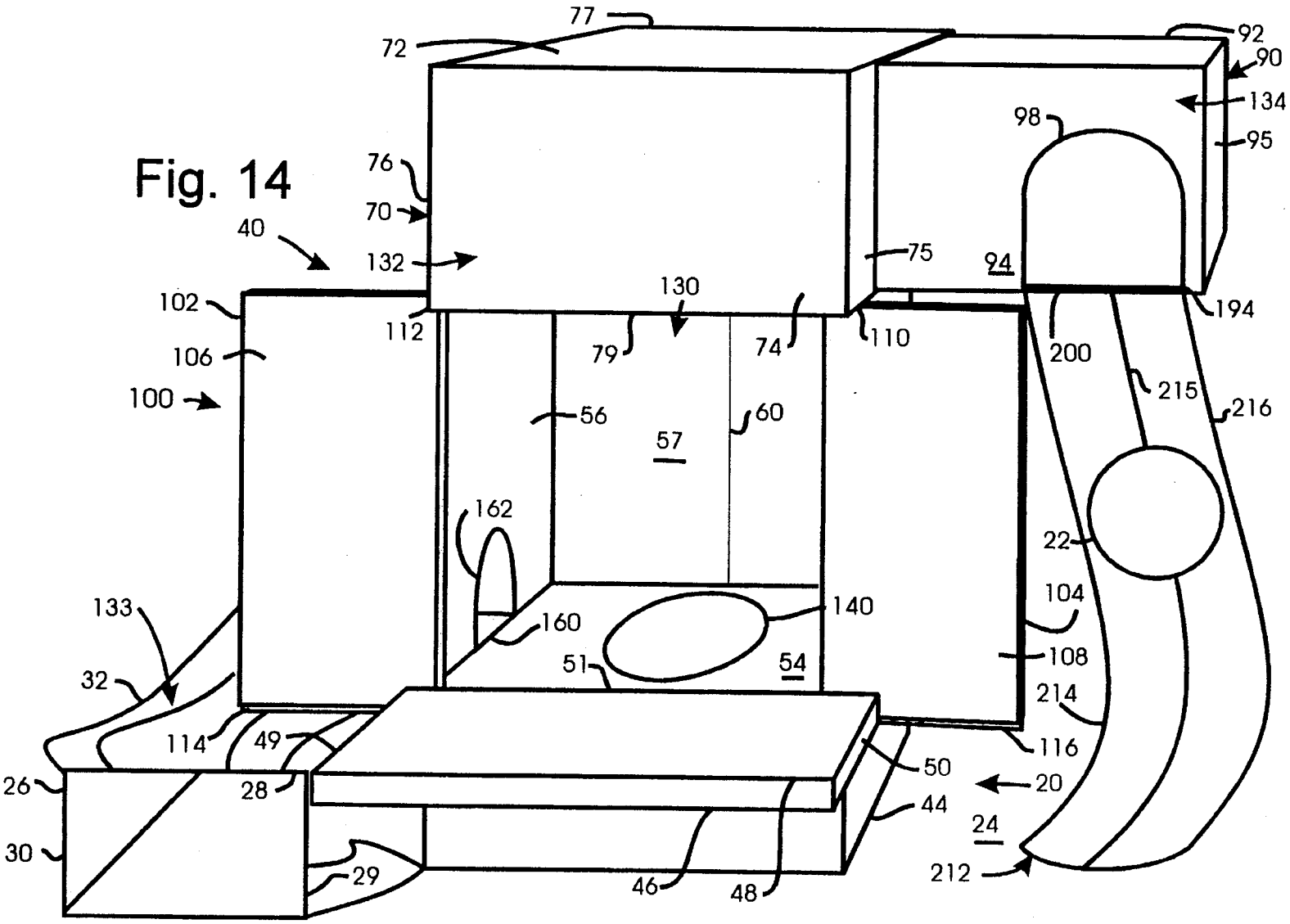
FIG. 14 illustrates the apparatus shown in FIG. 1 in which the first pinball is descending a wire ramp to the playfield.

During the second operating state, when lift 220 is fully ascended, lip 226 strikes the leading edge 199 of guide 192 and is rotated with respect to rack 240 as shown in FIG. 13. As a result, pinball 22 rolls into guide 192 and exits loft extension 90 from opening 98. Thereafter, pinball 22 descends on wire ramp 112 to playfield 24 as shown in FIG. 14.

A microprocessor or other control circuit may be easily programmed by those skilled in the art to control the first and second operation states, the movement of loft assembly 220, screens 102 and 104, diverter gate 164 and saucer cup 140.

Figure 15:
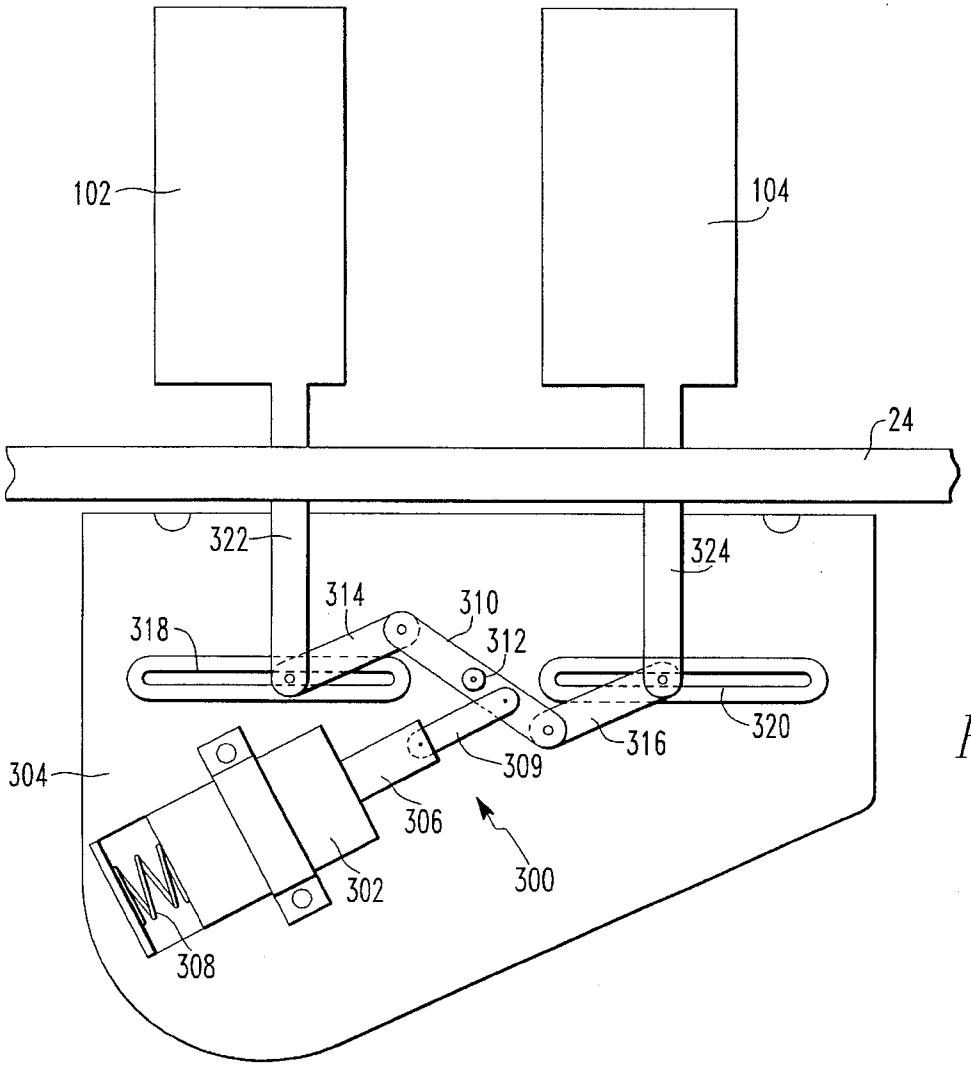
FIG. 15 illustrates a door moving mechanism for use in conjunction with apparatus illustrated in FIG. 1 in which the doors are positioned in an open configuration.
Figure 16:
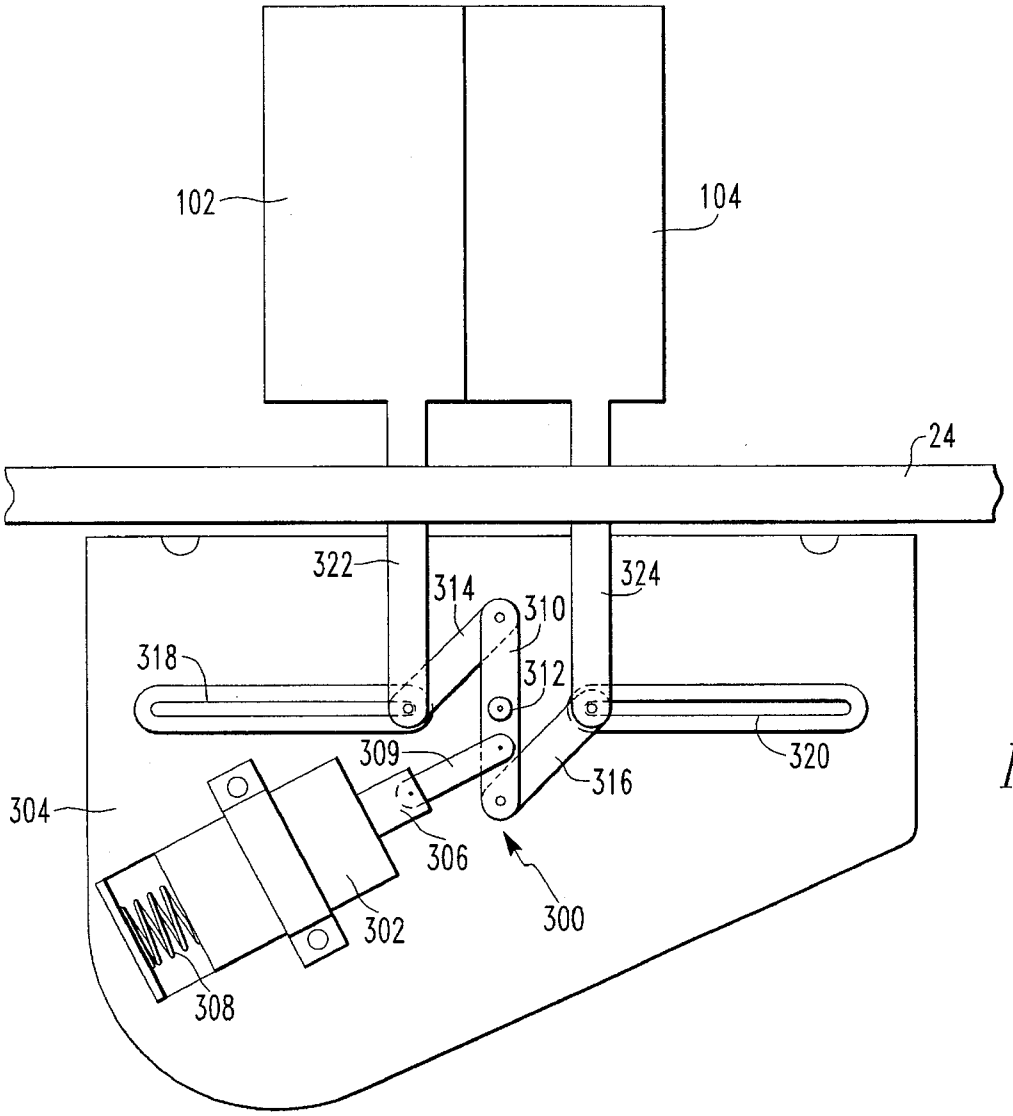
FIG. 16 illustrates the door moving mechanism illustrated in FIG. 15 in which the doors are positioned in a closed configuration.

Illustrated in FIGS. 15 and 16 is a further embodiment of the present invention which utilizes a solenoid assembly 300 to move the stage doors 102,104 which, as described hereinbefore, are slidably mounted to the stage assembly 40. For the sake of clarity, only those components linked to the stage doors and the stage doors themselves are illustrated in the figures.

The solenoid assembly 300 consists of a single solenoid 302 which is mounted to a bracket 304 which is in turn mounted to the underside of the playfield 24. While the illustrated embodiment shows the solenoid assembly 300 being disposed beneath the playfield 24 it is equally possible for the solenoid assembly 300 to be disposed above the playfield 24 and appropriately housed. The solenoid 302 comprises a plunger 306 which is biased by a spring 308 into a normally extended position. Connected to the plunger 306 is a link 308 which is in turn pivotally connected to a pivoting arm 310.

The pivoting arm 310 is pivotally mounted to the bracket 304 about a pivot point 312. The link 300 is pivotally connected to the pivoting arm 310 so as to be displaced from the pivot point 312. Also pivotally connected to the pivoting arm 310, at either end thereof and also positioned so as to be displaced from the pivot point 312, are links 314,316. Each of the links 314,316 are slidably engaged with a substantially horizontal slot 318,320 formed in the bracket 304 at the ends opposite their connection with pivoting arm 310. While the pivoting arm 310 and slots 318,320 are illustrated as being directly linked to or part of the bracket 304 it is understood that a separate plate or the like could be used to provide slots 318,320 and to carry the pivoting arm 310 which plate would, in turn, be connected to the bracket 304 or otherwise connected to the playfield 24. Finally, a pair of links 322,324 are pivotally connected at one end to the links 314,316 with the opposite ends thereof being fixedly connected to the respective doors 102,104. In the embodiment illustrated, the links 322,324 pass through slots (not shown) in the playfield 24 and the stage assembly 40 whereby the doors 102,104 may be connected with the solenoid assembly 300 for movement between open and closed positions. Furthermore, those skilled in the art will appreciate that conventional hardware is to be used in providing the pivotal connections and the slidable engagements described herein.

In play, as described hereinbefore, the stage doors 102, 104 are normally positioned in an open or separated configuration. When the stage doors 102,104 are positioned in the open configuration the solenoid 302 is not being supplied with a current and the spring 308 is biasing the plunger 306 to its extended position. To move the stage doors from the open configuration to the closed configuration a current is supplied to the solenoid 302 to generate an electromagnetic force which will draw the plunger 306 inward against the bias of the spring 308. As the plunger 306 moves inward, the plunger 306 will cause the pivoting arm 310 to rotate clockwise (when viewing the figures) about the pivot point 312.

The clockwise movement of the pivoting arm 310 causes movement of links 314,316. Specifically, as the pivoting arm 310 moves, the links 314,316 are pulled such that the ends of the links 314,316 slide within the slots 318,320 inward towards the pivot point 312. This sliding movement of the links 314,316 in the slots 318,320 in turn causes the doors 102,104 to move inward towards each other as the doors 102,104 follow the links 322,324 owing to the connection through links 322,324. This movement of the doors 102,104 and the links continues until the plunger 306 completes its inward stroke at which time the doors 102,104 will be fully closed.

As current is removed from the solenoid 302 the reverse operation will take place and the doors 102,104 will move back to the open position. Specifically, a removal of current will cause the plunger 306 to move outward owing to the force applied thereon by the spring 308. The outward movement of the plunger 306 pushes the pivoting arm 310 in the counter-clockwise direction (when viewed in the figures) which in turn causes the links 314,316 to be moved within the slots 318,320. In particular, the links 314,316 will be driven such that the ends thereof, engaged with the slots 318,320, will be driven outward and away from pivot point 312. As before, the doors 102,104 will follow the movement of the links 314,316 through links 322,324 until the doors attain the fully open Those skilled in the art will recognize that the preferred embodiment may be altered and modified without departing from the true spirit and scope of the invention as defined in the appended claims.

I claim:

1. In an amusement game, a device for moving a pair of movable objects comprising:

a solenoid having a plunger movable between an extended position and a retracted position;

an arm rotatable about a pivot point having first and second ends displaced from said pivot point, said arm being linked to said plunger at a point spaced from said pivot point;

a first link connected to said first end of said arm and adapted to move one of said movable objects; and a second link connected to said second end of said arm and adapted to move the other of said movable objects;

wherein movement of said plunger between said extended position and said retracted position causes rotation of said arm and simultaneous movement of both of said movable objects.

2. The device as recited in claim 1, further comprising a plate to which said arm is rotatably mounted, said plate further having a pair of slots wherein said first link is slidably engaged within one of said slots and said second link is slidably engaged within the other of said slots.

3. In an amusement game, a device for moving a pair of movable objects disposed above a playfield comprising:

a solenoid having a plunger movable between an extended position and a retracted position;

a plate having first and second slots;

an arm rotatably mounted to said plate about a pivot point having first and second ends displaced from said pivot point, said arm being linked to said plunger at a point spaced from said pivot point;

a first link having one end thereof connected to said first end of said arm and the other end thereof slidably engaged with said first slot; and a second link having one end thereof connected to said second end of said arm and the other end thereof slidably engaged with said second slot;

wherein said first link is adapted to move one of said movable objects and said second link is adapted to move the other of said movable objects such that movement of said plunger between said extended and retracted positions causes rotation of said arm and simultaneous movement of both of said movable objects.

4. The device as recited in claim 3, wherein said playfield is disposed in a first plane and said pair of movable objects move in a second plane substantially perpendicular to said first plane.

5. The device as recited in claim 4, wherein said first and second slots are disposed generally parallel to said first plane.

6. A pinball game using a pinball adapted to be propelled along a playfield, comprising a target mounted above said playfield;

first and second movable objects mounted above said playfield and movable between a closed position wherein said first and second movable objects are disposed substantially adjacent to each other and an open position wherein said first and second movable objects are disposed substantially apart from each other;

a solenoid having a plunger movable between an extended position and a retracted position in response to contact of said target by said pinball;

an arm rotatable about a pivot point having first and second ends displaced from said pivot point, said arm being linked to said plunger at a point spaced from said pivot point;

a first link connecting said first end of said arm to one of said movable objects; and a second link connecting said second end of said arm to the other of said movable objects;

wherein movement of said plunger between said extended and retracted positions causes said movable objects to move between said open and said closed positions.

7. The pinball game as recited in claim 6, wherein said playfield occupies a first plane and said movable objects move in a second plane substantially perpendicular to said first plane.

8. The pinball game as recited in claim 7, wherein said first and second movable objects comprise first and second doors behind which is disposed a part of said playfield into which said pinball may travel.

* * * * *